US009999841B2

(12) United States Patent
Reynolds

(10) Patent No.: US 9,999,841 B2
(45) **Date of Patent: *Jun. 19, 2018**

(54) CONSTRUCTION TOY ELEMENT AND SET

(71) Applicant: SPIN MASTER LTD., Toronto (CA)

(72) Inventor: Paul Andrew Reynolds, Toronto (CA)

(73) Assignee: SPIN MASTER LTD., Toronto (CA)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/467,539

(22) Filed: Mar. 23, 2017

(65) Prior Publication Data

US 2017/0189829 A1 Jul. 6, 2017

Related U.S. Application Data

(63) Continuation of application No. 14/473,721, filed on Aug. 29, 2014, now Pat. No. 9,636,601.

(51) Int. Cl.
*A63H 33/08* (2006.01)
*A63H 33/04* (2006.01)

(52) U.S. Cl.
CPC ..... *A63H 33/048* (2013.01); *A63H 33/08* (2013.01); *A63H 33/088* (2013.01)

(58) Field of Classification Search
CPC ..... A63H 33/06; A63H 33/08; A63H 33/048; A63H 33/088
USPC ..... 446/118, 124, 125, 126
See application file for complete search history.

(56) References Cited

U.S. PATENT DOCUMENTS 2,902,821 A 9/1959 Kelly, Jr.
3,128,514 A * 4/1964 Parker ..... A44B 18/00 2/300
3,562,077 A 2/1971 Raba
3,597,874 A 8/1971 Ogsbury et al.
3,603,025 A 9/1971 Heubl
3,626,632 A 12/1971 Bullock, Jr.
3,941,383 A * 3/1976 Clarke ..... A63B 43/005 273/348.4
3,953,030 A * 4/1976 Muchnick ..... A63B 43/005 2/19

(Continued)

FOREIGN PATENT DOCUMENTS

CN 1545430 A 11/2004
CN 201375819 Y 1/2010

(Continued)

OTHER PUBLICATIONS

Patent Evaluation Report for Chinese Patent Application No. ZL2015205694682.

*Primary Examiner* — Melba Bumgarner
*Assistant Examiner* — Joseph B Baldori
(74) *Attorney, Agent, or Firm* — Millman IP Inc.

(57) ABSTRACT

In a first aspect, a construction toy element is provided and includes a body and a first circumferential row of arms extending from the body. The body has an axis, and has a first axial end and a second axial end. A first circumferential row of arms extends from the body. Each arm includes a root end and a free end, and has a first connecting member thereon that is configured for connecting the construction toy element to another construction toy element. The root end projects from the body in a direction that is angled towards one of the first and second axial ends relative to a normal direction to a surface of the body.

5 Claims, 8 Drawing Sheets

(56) References Cited

U.S. PATENT DOCUMENTS 4,071,237 A * 1/1978 Hoogasian ..... A63F 7/382 273/440
4,169,303 A 10/1979 Lemelson
4,680,838 A * 7/1987 Astl ..... F16B 2/00 24/442
4,860,896 A * 8/1989 Snider ..... B65D 67/02 206/427
4,991,841 A * 2/1991 Paranto ..... A63B 43/00 446/490
5,238,438 A 8/1993 Glickman
5,325,569 A * 7/1994 Goulait ..... A44B 18/0049 24/448
5,457,856 A 10/1995 Murasaki
5,537,720 A 7/1996 Takizawa et al.
5,537,793 A 7/1996 Murasaki
5,685,050 A * 11/1997 Murasaki ..... A44B 18/0061 24/442
5,867,876 A 2/1999 Petersen
5,908,342 A 6/1999 Wolvin
6,061,881 A 5/2000 Takizawa
D431,848 S * 10/2000 Hubbard ..... D21/398
6,174,250 B1 * 1/2001 Hollis ..... A63B 43/005 473/503
6,280,282 B1 * 8/2001 Puchalski ..... A63H 33/048 446/125
6,546,604 B2 * 4/2003 Galkiewicz ..... A44B 18/0053 24/306
6,588,073 B1 * 7/2003 Zoromski ..... A44B 18/0015 24/446
6,607,419 B2 8/2003 Day et al.
6,645,101 B1 * 11/2003 Wong ..... A63B 43/00 473/594
7,141,283 B2 * 11/2006 Janzen ..... A44B 18/0049 24/442
7,225,510 B2 * 6/2007 Gallant ..... A44B 18/0042 24/451
D561,277 S * 2/2008 Chernick ..... D21/398
8,663,409 B2 * 3/2014 Mueller ..... A44B 18/0061 156/298
2002/0086605 A1 7/2002 Cheung
2002/0086606 A1 7/2002 Bottomy
2006/0228980 A1 10/2006 Hammond
2013/0178130 A1 7/2013 Balint

FOREIGN PATENT DOCUMENTS

CN 102008825 A 4/2011
CN 102008826 A 4/2011

* cited by examiner

CONSTRUCTION TOY ELEMENT AND SET

CROSS-REFERENCE TO RELATED APPLICATIONS

This application is a continuation of U.S. application Ser. No. 14/473,721 filed Aug. 29, 2014, the content of which is incorporated herein by reference in its entirety.

FIELD OF DISCLOSURE

This disclosure relates generally to the field of construction toy sets and elements for such sets.

BACKGROUND OF DISCLOSURE

Construction toy sets are well known and typically comprise a set of blocks that are connectable together to form a structure. These sets suffer from several drawbacks. Structures are typically relative slow to create since the blocks are usually assembled one-by-one. Furthermore, the blocks typically connect together in relatively fixed ways, resulting in little variation in how they can be joined to adjacent blocks. Such blocks can represent a safety risk also to small children if ingested. There is consequently a need for a construction toy set that overcomes one or more of these problems, while still being inexpensive to produce.

SUMMARY OF DISCLOSURE

In a first aspect, a construction toy element is provided and includes a body and a first circumferential row of arms extending from the body. The body has an axis, and has a first axial end and a second axial end. A first circumferential row of arms extends from the body. Each arm includes a root end and a free end, and has a first connecting member thereon that is configured for connecting the construction toy element to another construction toy element. The root end projects from the body in a direction that is angled towards one of the first and second axial ends relative to a normal direction to a surface of the body.

In a second aspect, a construction toy is provided and includes a body and a first circumferential row of arms extending from the body. The body has an axis, and has a first axial end and a second axial end. A first circumferential row of arms extends from the body. Each arm includes a root end and a free end, and has a first connecting member thereon that is configured for connecting the construction toy element to another construction toy element. The root end has a first axial side that is connected to the body by a first fillet with a first effective radius and has a second axial side that is connected to the body by a second fillet with a second effective radius that is larger than the first effective radius.

In yet another aspect, a construction toy element is provided, having a body and a plurality of rows of arms that extend from the body. Each arm has a root end and a free end, and has a first hook on the free end and a second hook intermediate the free end and the root end.

In yet another aspect, a construction toy set is provided that includes a plurality of the elements described above.

Other features and advantages will be apparent to one skilled in the art based on the disclosure provided herein.

BRIEF DESCRIPTION OF THE DRAWINGS

The foregoing and other aspects of the disclosure will be more readily appreciated by reference to the accompanying drawings, wherein.

DETAILED DESCRIPTION OF EMBODIMENTS

Figure 1:
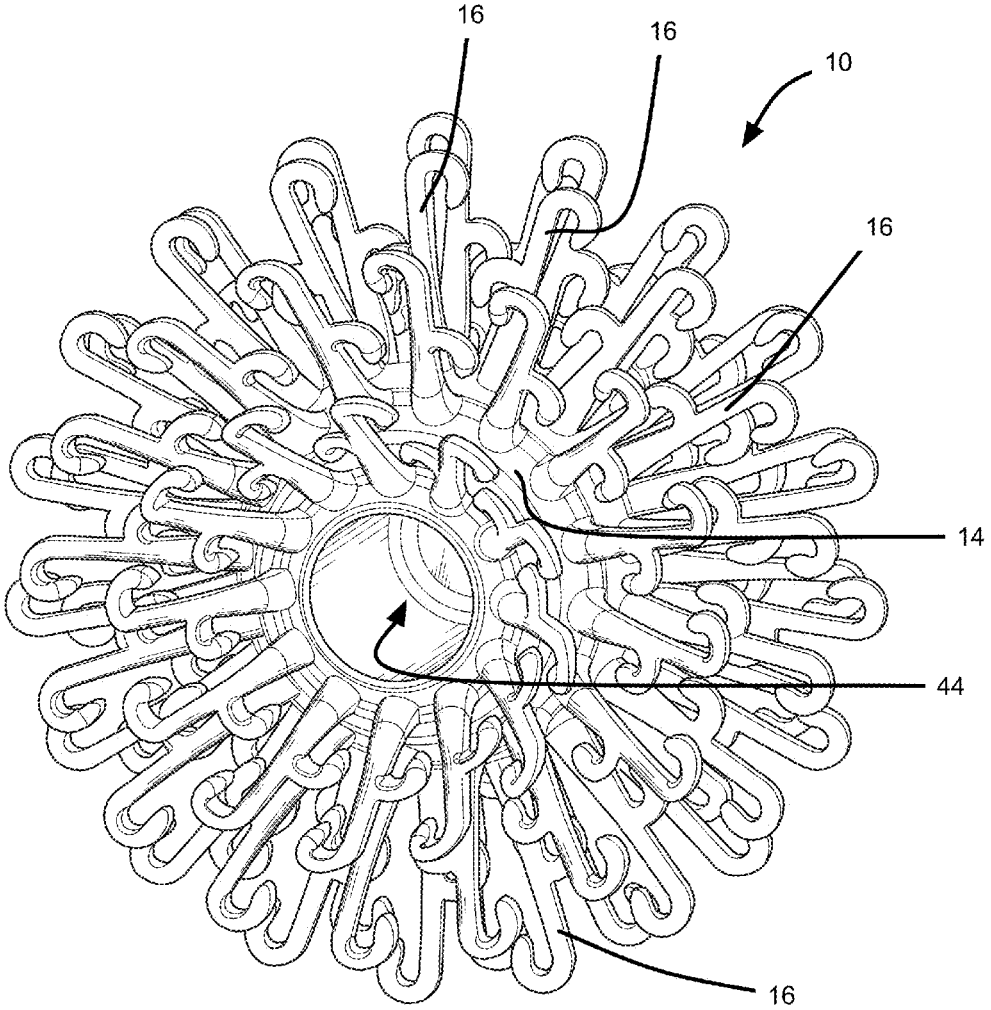
FIG. 1 is a perspective view of a construction toy element in accordance with an embodiment of the present invention, including a body and arms that extend from the body.
Figure 2:
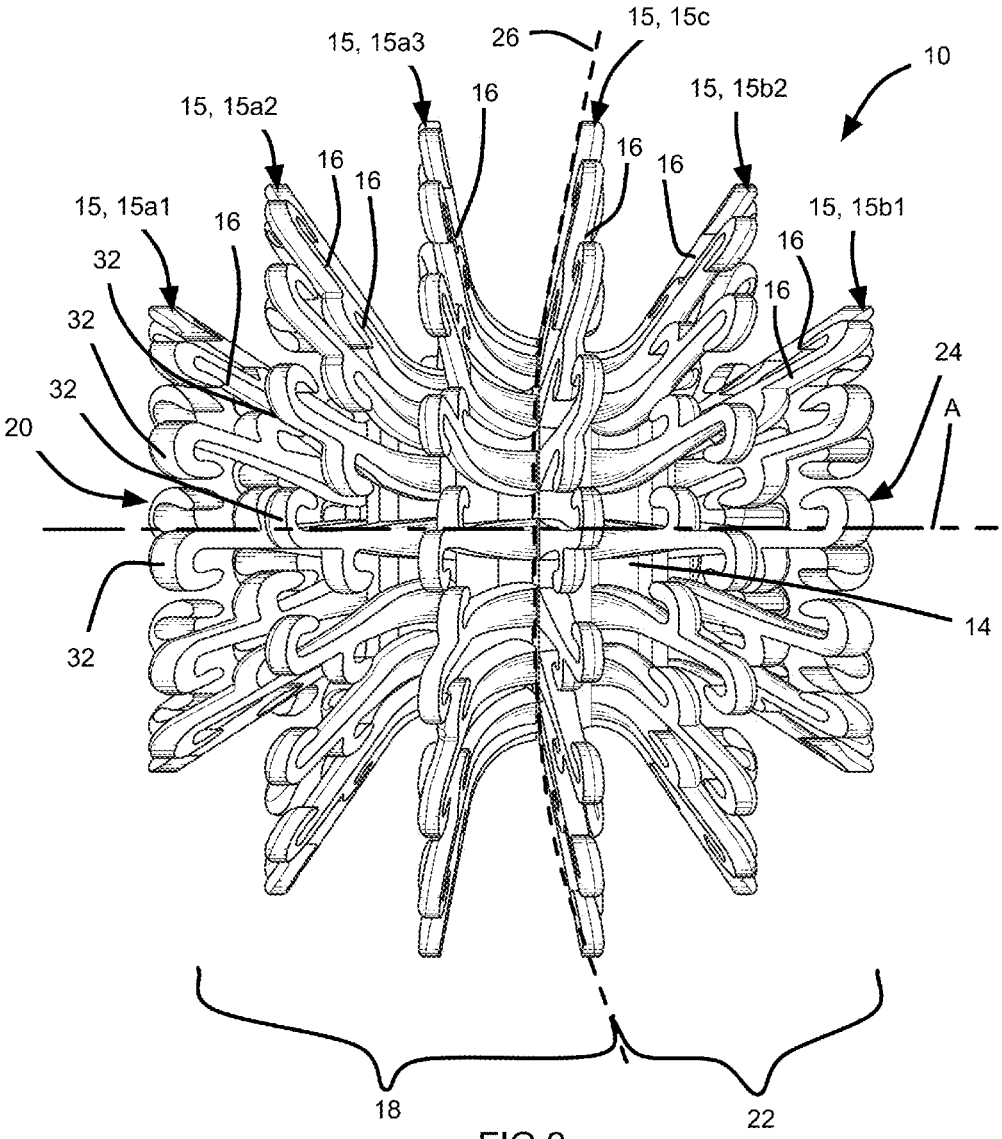
FIG. 2 is a side elevation view of the construction toy element shown in FIG. 1.

Reference is made to FIGS. 1 and 2, which show a construction toy element 10 for use as part of a construction toy set 12 that contains a plurality of the construction toy elements 10, in accordance with an embodiment of the invention.

The construction toy element 10 (which may, for convenience be referred to simply as element 10) includes a body 14 and a plurality of rows 15 (FIG. 2) of arms 16 extending from the body 14.

Referring to FIG. 2, the body 14 has an axis A, and has a first axial portion 18 on which there is a first axial end 20 and a second axial portion 22 on which there is a second axial end 24. The first and second axial portions 18 and 22 meet at a boundary 26, described further below.

Figure 3:
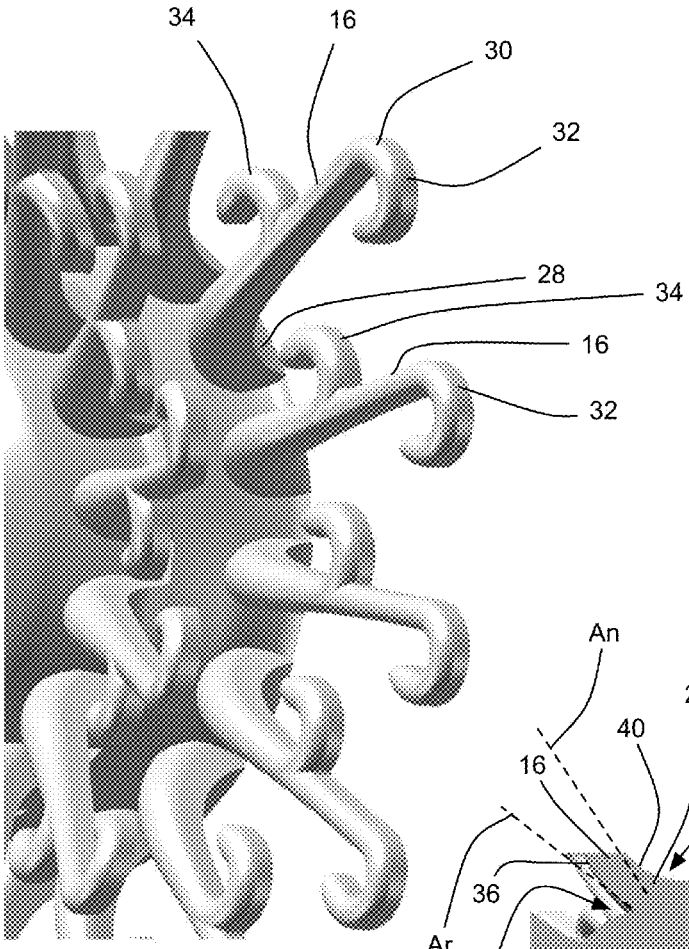
FIG. 3 is a magnified perspective view of a portion of the construction toy element in FIG. 1, showing the structure of some of the arms.

The plurality of rows 15 of arms 16 as shown in FIG. 2 include first, second and third rows 15*a*1, 15*a*2 and 15*a*3 on the first axial body portion 18, first and second rows 15*b*1 and 15*b*2 on the second axial body portion 22, and a boundary row 15*c* that is on the boundary 26. Referring to FIG. 3, each arm 16 includes a root end 28 and a free end 30, and has first and second connecting members 32 and 34 thereon that are configured for connecting the construction toy element 10 to similar connecting members on another construction toy element 10 (as shown, for example, in FIG. 13). Referring to FIG. 5, the root end 28 may project from the body 14 in a direction that is angled towards one of the first and second axial ends 20 and 24 relative to a normal direction to a surface of the body 14. A line representing a normal direction to the surface of the body is shown at An in FIGS. 4 and 5. A line representing the direction of the root end 28 is shown as Ar. As can be seen in FIG. 5, for the arm shown at 16*a*, the line Ar is angled towards the axial end 20 relative to the line An. As a result, the arm 16*a* is capable of easily flexing in a direction towards the first axial end 20. Similarly, for the arm shown at 16*b*, the line Ar is angled towards the axial end 24 relative to the line An, thereby permitting the arm 16*b* to flex easily towards the second axial end 24. A benefit to this structure is described further below in relation to the manufacture of the element 10. Referring to FIG. 5, it will be noted that each of the arms 16 in rows 15*a*1 and 15*a*3 also have root ends that are angled towards the first axial end 20 relative to locally normal directions to the surface of the body 14. It will be further noted that the arms 16 that make up the rows 15*b*1 and 15*b*2 are angled towards the second axial end 24 relative to a normal direction to a normal line to the surface of the body 14. Also, the root ends 28 of the arms 16 of the boundary row 15*c* extend generally normally from the surface of the body 14, although this does not need to be the case.

Figure 4:
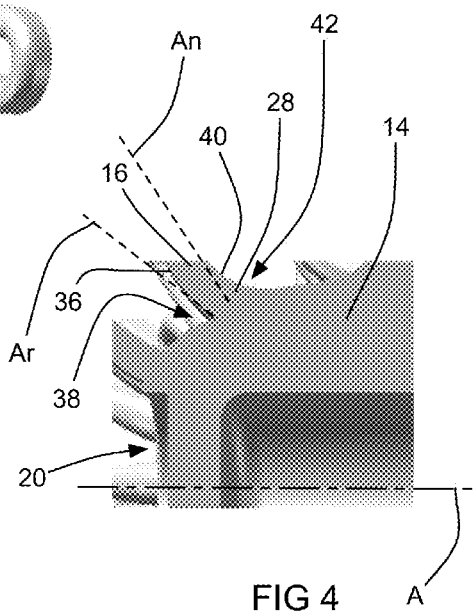
FIG. 4 is a highly magnified sectional side elevation view of a portion of the construction toy element, showing the connection between one of the arms and the body.
Figure 5:
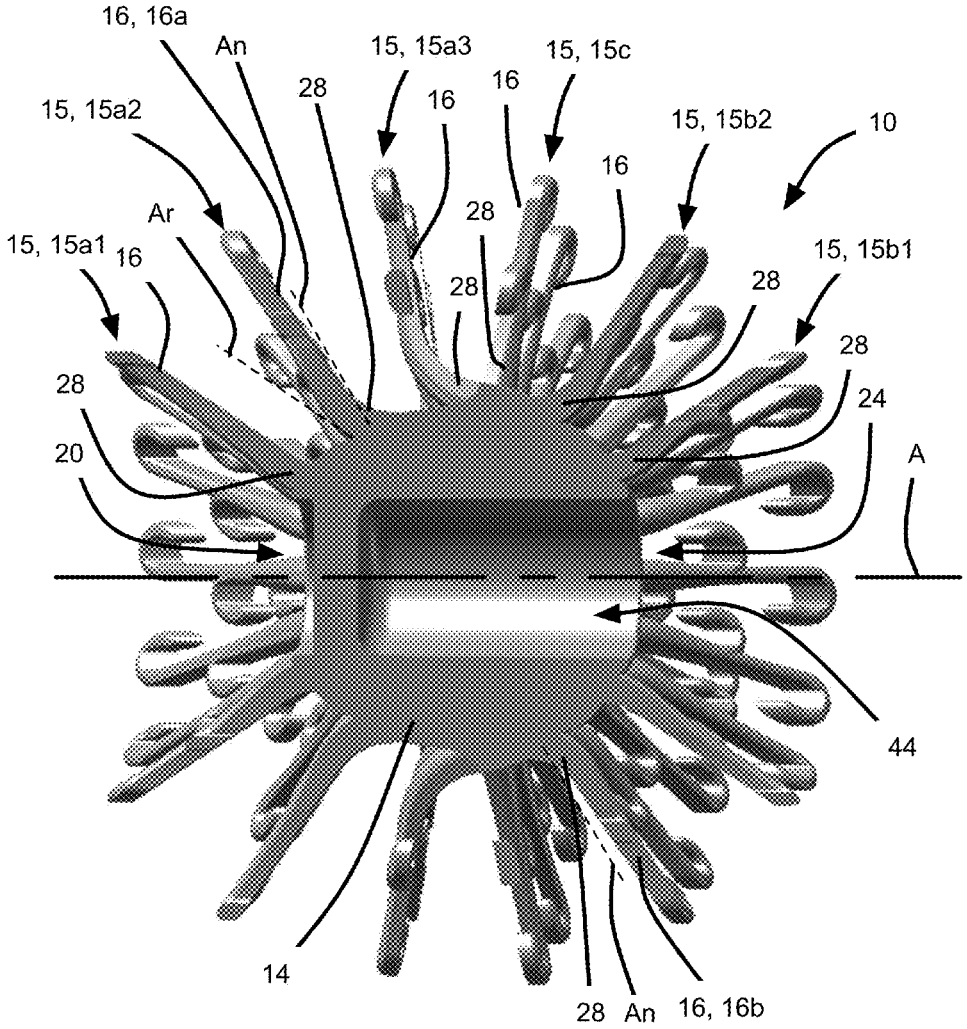
FIG. 5 is a sectional side elevation view of the construction toy element shown in FIG. 1.

With reference to FIG. 4, it will also be noted that the root end 28 has a first axial side 36 that is connected to the body 14 by a first fillet 38 with a first effective radius, and has a second axial side 40 that is connected to the body 14 by a second fillet 42 with a second effective radius that is larger than the first effective radius. This facilitates the bending of the arm 16 towards the first axial side 36 under circumstances in which it is needed, as is described further below.

Each of the connecting members 32 and 34 may be a hook, as shown in FIG. 3. As can be seen in FIG. 2, the hooks 32 in each row 15 all may be oriented in the same direction, and the hooks 32 in each adjacent row 15 may be oriented in the opposite direction. Thus, the first hooks 32 on all the arms 16 of the first circumferential row 15*a*1 face in a first circumferential direction, and the first hooks 32 of the second circumferential row 15*a*2, which is adjacent the first circumferential row 15*a*1 face in a second circumferential direction that is opposite the first circumferential direction. This may help the element 10 connect to adjacent elements 10 during assembly of a toy. The first hook 32 is shown at the free end 30 of each arm 16, whereas the second hook 34 is shown at an intermediate point on each arm 16, and is oriented in the opposite direction to the first hook 32.

By providing a hook (i.e. hook 32) on the end of the arm 16 and a hook (i.e. hook 34) on an intermediate portion of the arm 16 (i.e. intermediate the free end 30 and the root end 28), the element 10 is provided with more opportunities to connect to an adjacent element 10 when the two elements 10 are brought together. Furthermore, connections can be made between the hooks 32 on an arm on one element 10 with the hooks 34 on the arm of an adjacent element 10, while the hooks 32 on the other element 10 can connect with the hooks 34 on the first element 10, thereby strengthening the connection. Additionally, because the bodies 14 of the elements 10 are generally spherical, when two elements 10 are brought into proximity of one another, they are nearest each other in one spot and the surfaces of the bodies 14 are further and further spaced from each other due to the generally spherical curvature of the bodies 14. By providing connecting members both at the free ends 30 and intermediate the free ends 30 and the root ends 28, one can obtain connections between hooks 32 on one element 10 and the hooks 34 on the other element 10 in the region where the bodies 14 are closest to each other, and connections between hooks 32 on one element 10 and hooks 32 on the other element 10, thereby increasing the possible number of connections that are formed between two adjacent elements. It will further be noted that the spacing between the arms 16 in each row also facilitates bringing the bodies 14 of two adjacent elements 10 closer together. If the density of the arms 16 was so high that the root ends 28 of the arms 16 were immediately adjacent on another on each element 10, then there would not be space for an arm 16 from another element 10 to be inserted between them. By spacing the arms 16 at least sufficiently to receive the free end 30 of an arm 16 from an adjacent element 10 there is a greater probability of generating a connection between the intermediate hooks 34 on the arms 16 of the two elements 10.

Figure 11:
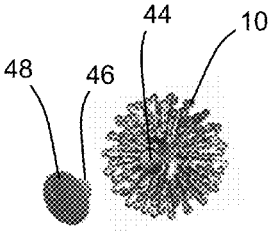
FIGS. 11 and 12 are perspective exploded views of the construction toy element with different examples of accessories that are connectable to it.
Figure 12:
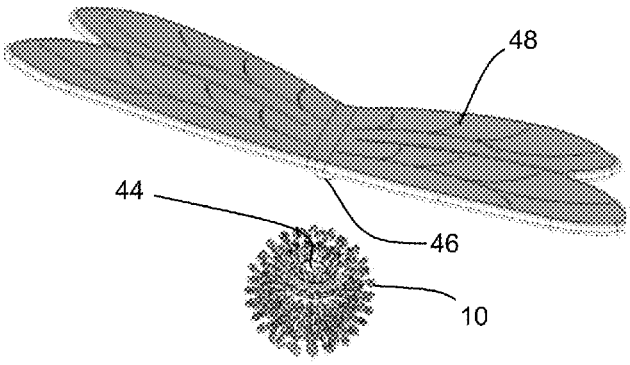

As can be seen in FIGS. 1 and 5, the element 10 has a receiving aperture 44 that is configured to receive a mounting projection 46 (FIGS. 11 and 12) on an accessory, examples of which are shown at 48. For example, the accessory 48 may be a pair of dragonfly wings as shown in FIG. 12, or an eye as shown in FIG. 11. The receiving aperture 44 also serves to reduce the overall amount of material that is needed to form the element 10, which results in a lower cost for the element 10.

Figure 6:
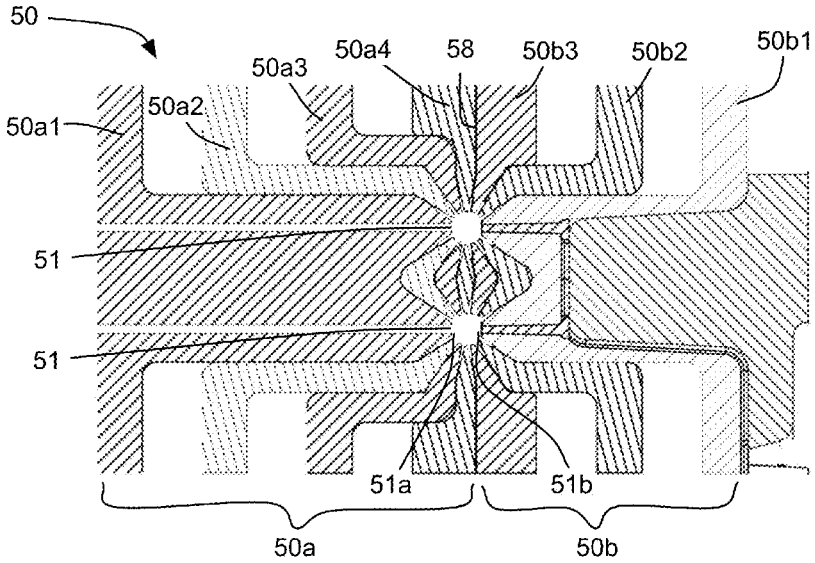
FIG. 6 is a sectional side elevation view of a mold that can be used for the production of the construction toy element shown in FIG. 1, in a closed position.

Reference is made to FIGS. 6-9, which illustrate an injection molding process that can be used for the production of the construction toy elements 10. FIG. 6 shows a mold 50 in a closed position. The mold 50 includes a first mold half 50*a* and a second mold half 50*b*. The mold halves 50*a* and 50*b* together define a plurality of mold cavities 51 for forming the elements 10. Mold half 50*a* defines a first axial end 51*a* of the mold cavities 51, while mold half 50*b* defines a second axial end 51*b* of the mold cavities 51. Each mold half 50*a* and 50*b* includes a plurality of mold plates. The mold plates are shown individually as first, second, third and fourth mold plates 50*a*1, 50*a*2, 50*a*3 and 50*a*4 which make up mold half 50*a* and which form the first axial portion 18 of the element 10 (FIG. 2), and first, second and third mold plates 50*b*1, 50*b*2 and 50*b*3 (FIG. 6) which make up mold half 50*b* and which form the second axial portion 22 of the element 10 (FIG. 2).

Figure 7:
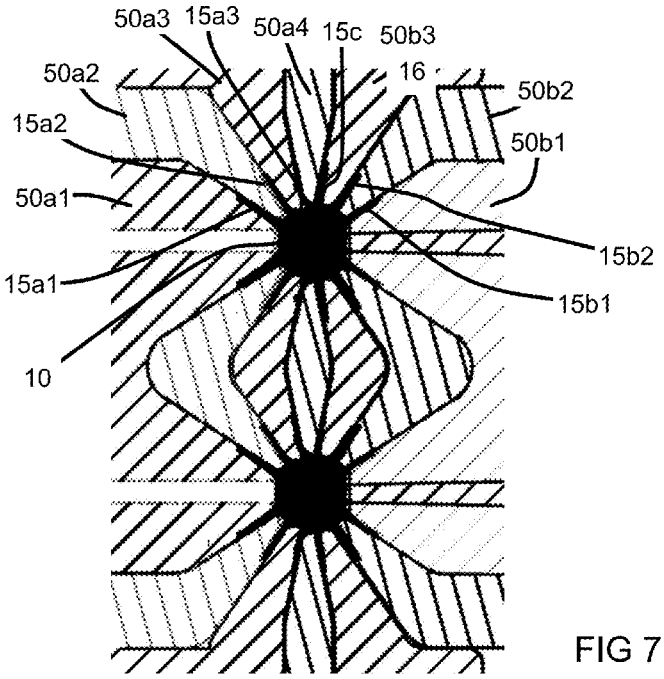
FIG. 7 is a magnified sectional side elevation view of the mold shown in FIG. 6, in the closed position and filled with melt.

FIG. 7 illustrates the mold 50 after injection of the melt has taken place. As shown in FIG. 7, the mating surfaces of the mold plates 50*a*1 and 50*a*2 together form row 15*a*1 of the arms 16. The mating surfaces of the mold plates 50*a*2 and 50*a*3 together form row 15*a*2 of the arms 16. The mating surfaces of the mold plates 50*a*3 and 50*a*4 together form row 15*a*3 of the arms 16. The mating surfaces of the mold plates 50*b*1 and 50*b*2 together form row 15*b*1 of the arms 16. The mating surfaces of the mold plates 50*b*2 and 50*b*3 together form row 15*b*2 of the arms 16. The mating surfaces of the mold plates 50*a*4 and 50*b*1 together form boundary row 15*c* of the arms 16.

Figure 8:
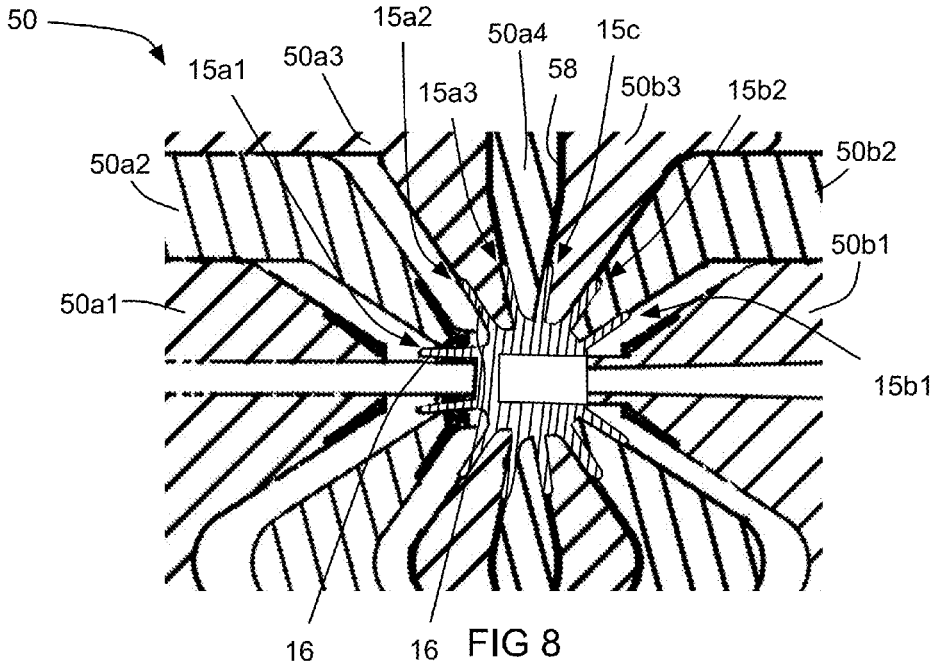
FIG. 8 is a sectional side elevation view of the mold shown in FIG. 6, in a partially open position.
Figure 10:
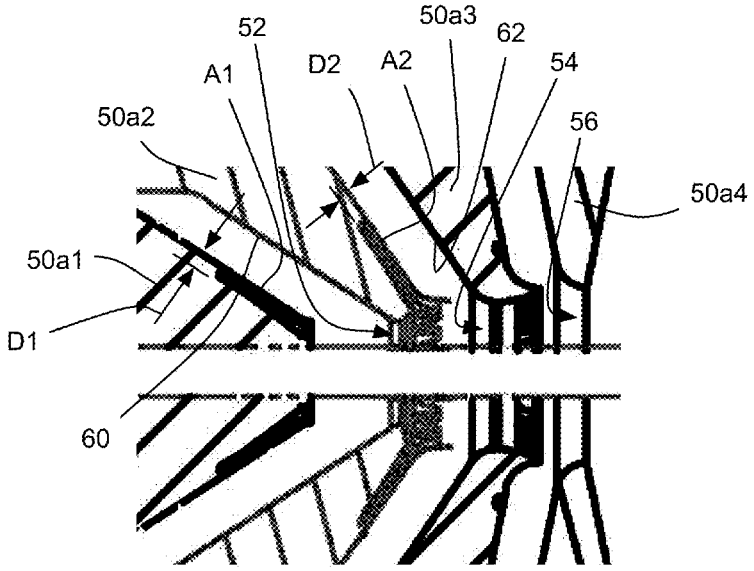
FIG. 10 is a highly magnified sectional side elevation view of the mold shown in FIG. 6 showing portions of one of the mold cavities in the mold.

Once melt has been injected into the mold cavities 51, the melt is cooled so as to form the element 10. The mold 50 is then opened and the element 10 is ejected from the mold 50. In order for a mold to be cost effective in the production of the elements 10, it is beneficial to be able to have the mold cavities 51 close to each other in the mold, so that each mold can produce many elements 10 simultaneously. In general, the use of slides in a mold is undesirable for several reasons. Slides represent potential leakage paths for melt, and they render the mold more complex to make, operate and maintain. Additionally, they can significantly reduce the number of mold cavities 51 that can fit in a mold. Advantageously, by configuring the element 10 with the arms 16 arranged as described above, and by using selected materials for the manufacture of the element 10, the arms 16 are sufficiently flexible that it is possible to manufacture the elements 10 in the mold 50 without the use of slides. FIG. 8 shows the mold 50 whereby some of the mold plates have been partially opened (i.e. separated from one another). As an initial step (which may take place prior to the step shown in FIG. 8), the mold plate 50*a*1 has separated from plate 50*a*2, so as to expose the arms 15*a*1. In FIG. 8, the plate 50*a*2 has also separated from plate 50*a*3. By configuring the arms 16 of row 15*a*1 to be able to bend towards the first axial end 20, the arms 16 of row 15*a*1 can bend as needed to pull through the aperture in mold plate 50*a*2 as it separates from mold plate 50*a*3. The aperture in mold plate 50*a*2 is shown at 52 in FIG. 10. The same is true for all of the arms 16 from the rows 15*a*2, 15*a*3, 15*b*1 and 15*b*2 as the associated mold plates separate from each other to release the element 10. In other words, these arms 16 as needed towards whichever axial end 20 or 24 is necessary to facilitate their withdrawal through an associated aperture in an associated mold plate 50. FIG. 10 shows the apertures in the mold plates 50*a*2, 50*a*3 and 50*a*4, at 52, as noted above, at 54 and at 56. There are similar apertures in the mold plates 50*b*2 and 50*b*3.

While the arms 16 from rows 15*a*1-15*a*3 and 15*b*1-15*b*2 are rendered flexible to permit their flexure as they are withdrawn through apertures in mold plates, the arms 16 from boundary row 15*c* are not required to be flexible in this way, as the parting line of the mold plates 50*a*4 and 50*b*3 (shown at 58 in FIGS. 6 and 8) represents the main parting line between the mold halves 50*a* and 50*b*. Thus, the arms 16 of row 15*c* do not have to be withdrawn through an aperture in a mold plate 50.

Figure 9:
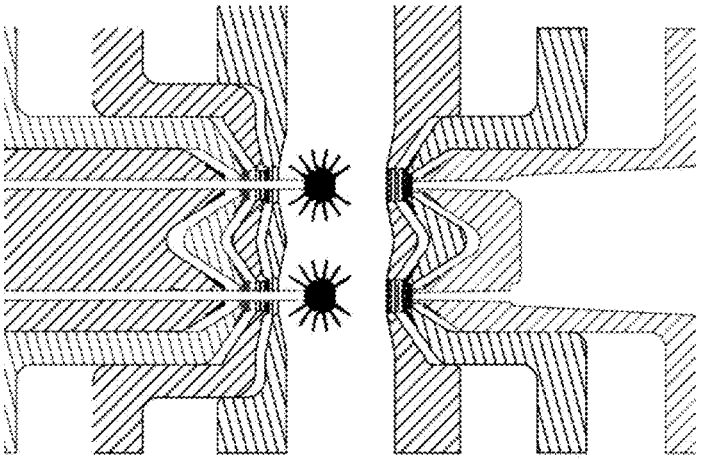
FIG. 9 is a sectional side elevation view of the mold shown in FIG. 6, in a fully open position.

FIG. 9 shows the mold halves 50*a* and 50*b* separated so as to release the molded elements 10.

It will be observed in FIG. 2 that the axial side of each arm 16 that faces towards the associated axial end of the element 10 is rounded in profile, but that the opposing axial side of the arm 16 has a flat profile. Referring to FIG. 10, the flat profile is the direct result of forming, for each arm 16, the depth of the associated arm portion of the mold cavity is entirely formed in one mold plate, while the adjacent mold plate acts simply as a flat cover member. For example, as shown in FIG. 10, a first arm portion of the mold cavity is shown at A1. The depth of the first arm portion A1 is shown at D1. As can be seen, the entire depth D1 of the arm portion A1 is formed in mold plate 50*a*1, and the mating surface (shown at 60) of mold plate 50*a*2 simply acts as a cover plate to the arm portion A1. Similarly the entire depth D2 of arm portion A2 is formed in mold plate 50*a*2, while the mating surface (shown at 62) of mold plate 50*a*3 acts simply as a flat cover member. It will be noted that the depth of each arm portion of the mold cavity 51 is formed in a mold plate surface that is facing away from the associated axial end of the mold cavity, while the mold plate surface acting as a flat cover member is the surface that faces the associated axial end of the mold cavity. For example, as shown in FIG. 1, the surface with the depth D1 of the arm portion A1 is the surface facing away from axial end 51*a*, while surface 60 of mold plate 50*a*2 faces axial end 51*a*.

Providing the arm portions of the mold cavities in this way means that, when plates 50*a*1 and 50*a*2 separate from each other, the arm 16 of the molded element 10 is situated on a flat surface 60 and can therefore easily be pulled through the aperture 52 when mold plates 50*a*2 and 50*a*3 separate from each other. By contrast, if half of the depth of the mold cavity arm portion A1 resided on plate 50*a*1 and half on mold plate 50*a*2, then the half on mold plate 50*a*2 would resist releasing the arm 16 so that the arm 16 could be withdrawn through the aperture 52 as needed, potentially resulting in damage to the arm 16.

In the embodiment shown in FIGS. 1-13, the construction toy element 10 had 6 rows of arms. It will be understood that the element 10 could alternatively have any other suitable number of rows of elements. For example, the element 10 could have five rows of arms 16. An example of such an embodiment is shown in FIG. 14. FIG. 14 shows the release of a five-row element 10, whereby the middle row is the boundary row 15*c*, and wherein each axial portion has two rows of arms (15*a*1 and 15*a*2, and 15*b*1 and 15*b*2 respectively). The mold used for the manufacture of such an element is also shown in FIG. 14.

Materials that can be used for the element 10 may be any suitably soft flexible material. Some examples include EVA (ethylene-vinyl acetate), PP (polypropylene), PE (polyethylene), or suitable mixtures thereof.

It has been found that the element 10 is advantageous in that it does not need to be assembled into a structure one element 10 at a time. Instead, it can be assembled into a structure en masse by cupping a group of many elements all at one and molding the group as desired. There is no particular orientation that is necessary for one element 10 to connect to another element 10, due to the many connecting members on each of them. This feature facilitates molding the elements 10 en masse. This is not possible with typical construction bricks of the prior art, which must be arranged very deliberately in specific orientations relative to one another before a connection can be made between them.

Figure 13:
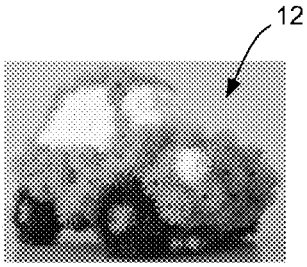
FIG. 13 is a perspective view of a construction toy set that includes a plurality of the construction toy elements shown in FIG. 1.
Figure 14:
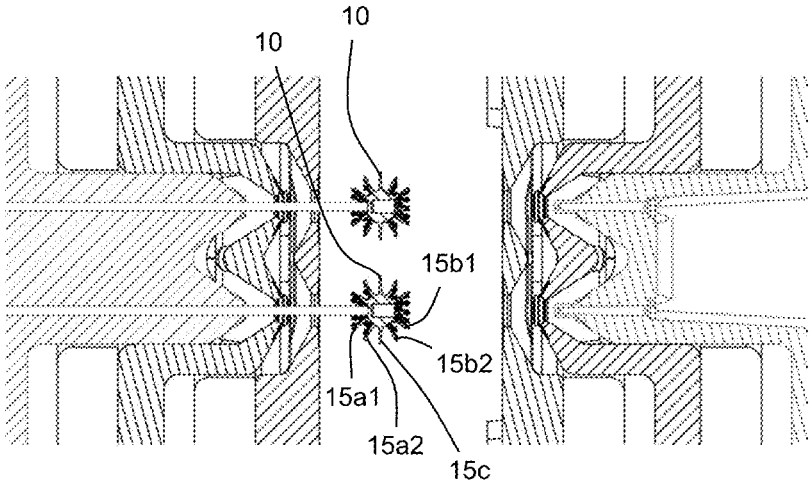
FIG. 14 is a sectional side elevation view of a mold used for the production of a variant of the construction toy element shown in FIG. 1, having five rows of arms instead of six rows.

It will be noted that the creations that are made with the elements 10 (an example of which is shown in FIG. 13) have a 'fuzzy' appearance (due to the presence of the arms 16), and can be generally less-structured looking than creations made with typical prior art construction bricks. These features lend the creations made with elements 10 a more organic look. Additionally, it will be noted that the creations made with the elements 10 will be generally flexible because of the flexibility in the arms 16 and the ability of the hooks 32 and 34 to change position while maintaining a connection with hooks 32 or 34 from an adjacent element 10.

Figure 15:
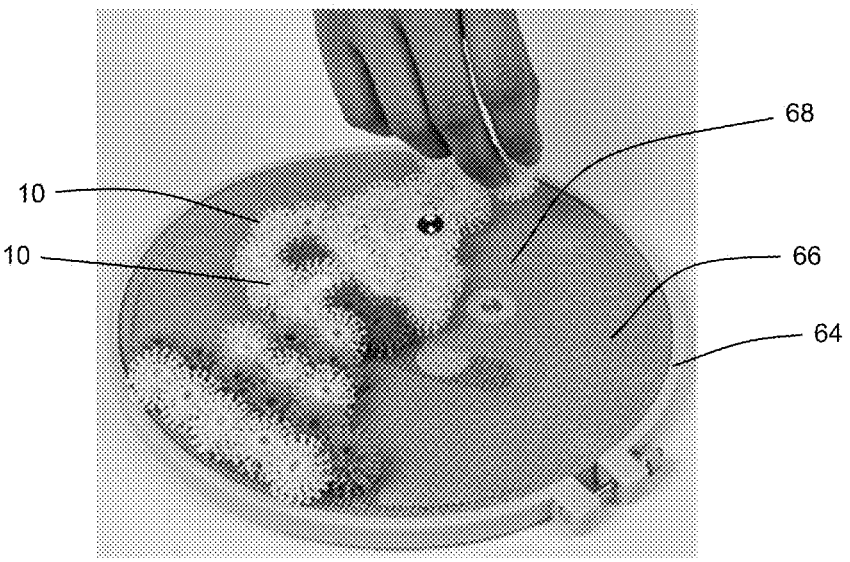
FIG. 15 is a perspective view of a base that can be used to assist in the formation of a creation with a plurality of the construction toy elements 10.

Reference is made to FIG. 15, which shows a base 64 that can be used to assist in the creation of certain types of design for the toy. The base 64 includes a loose mesh structure 66 with a plurality of apertures that are used to receive the hooks 32 and 34. The base 64 can have a pre-printed pattern 68 (e.g. printed on a removable card that sits under the mesh 66) to assist the user in selecting the correctly coloured elements 10 that are needed to form the creation.

It will be noted that, for some construction toy elements, such as bricks, there is a risk that a child can ingest them, and are hazardous for two reasons. First, the brick itself can block the airway of a child if it becomes lodged in the child's throat. Secondly, the corners of the brick can be sharp and can injure the child. By contrast, the element 10 has a significant amount of open space, so that even if it became lodged in a child's throat, some air could get through due to the spaces between the arms 16. Additionally, the hooks 32 at the free ends 30 of the arms 16 are rounded and point inwardly towards the body 14 of the element 10. As a result, there are no sharp corners to injure a child in the event that an element 10 is ingested.

Those skilled in the art will understand that a variety of modifications may be effected to the embodiments described herein without departing from the scope of the appended claims.

The invention claimed is:

1. A construction toy element, comprising:

a body having a length and a width, wherein the body has a surface profile over the length that differs from a surface profile over the width, and has a longitudinal axis, and a first axial end and a second axial end; and a plurality of arms extending from the body, wherein each arm of said plurality of arms includes a root end and a free end, and has a first connecting member thereon that is configured for connecting the construction toy element to another construction toy element, wherein the first connecting member comprises a first hook having a hook end that extends circumferentially relative to the longitudinal axis, wherein the body has a boundary line, wherein at least some of the plurality of arms are situated on a first side of the boundary line, wherein the root end of said at least some of the plurality of arms situated on the first side of the boundary line projects from the body in a direction that is angled towards the first axial end relative to a normal direction to a surface of the body immediately about the root end, and the root end of any arms of said plurality of arms situated on a second side of the boundary line projects from a surface of the body in a direction that is angled towards the second axial end relative to a normal direction to the surface of the body immediately about the root end, and wherein the body has a substantially flat region devoid of any of the plurality of arms at one of the first and second axial ends and an aperture configured to receive an object that is separate from the construction toy element at the other of the first and second axial ends.

2. The construction toy element as claimed in claim 1, wherein the plurality of arms includes a first circumferential row of arms on the first side of the boundary line, and the first hook on the first connecting member on all the arms of the first circumferential row of arms face in a first circumferential direction.

3. The construction toy element as claimed in claim 2, wherein the plurality of arms includes a second circumferential row of arms adjacent the first circumferential row of arms, wherein the first hook on the first connecting member of each arm of the second circumferential row of arms faces in a second circumferential direction that is opposite the first circumferential direction.

4. The construction toy element as claimed in claim 1, wherein each arm from the plurality of arms has a second connecting member thereon which comprises a second hook that is configured for connecting the construction toy element to another construction toy element, wherein the second hook faces in a second circumferential direction that is opposite the first circumferential direction.

5. The construction toy element as claimed in claim 1, wherein, at the first axial end, the body has the substantially flat region and wherein at least some of the plurality of arms extend axially past the substantially flat region.

* * * * *